United States Patent [19]

LaBass et al.

[11] Patent Number: 5,044,863

[45] Date of Patent: Sep. 3, 1991

[54] SIDE REFUSE LOADER FOR VEHICLES

[75] Inventors: Donald D. LaBass, Catoosa; Willie A. Hutson, Tulsa, both of Okla.

[73] Assignee: Crane Carrier Company, Tulsa, Okla.

[21] Appl. No.: 534,681

[22] Filed: Jun. 6, 1990

[51] Int. Cl.[5] ..... B65F 3/00

[52] U.S. Cl. ..... 414/409; 414/408; 414/421

[58] Field of Search ..... 414/403, 404, 406, 407, 414/408, 409, 419, 420, 421, 422, 423, 424, 540, 541, 595

[56] References Cited

U.S. PATENT DOCUMENTS

| | | | |
|---|---|---|---|
| 3,148,793 | 9/1964 | Walter . | |
| 3,910,434 | 10/1975 | Ebeling et al. | 414/408 |
| 4,427,333 | 1/1984 | Ebeling | 414/409 |
| 4,773,812 | 9/1988 | Bayne et al. | 414/408 |
| 4,872,801 | 10/1989 | Veazel et al. | 414/409 |

FOREIGN PATENT DOCUMENTS

| | | | |
|---|---|---|---|
| 1020503 | 2/1953 | France | 414/407 |

OTHER PUBLICATIONS

HLRL Container Pak-Mor Catalog.

*Primary Examiner*—Frank E. Werner

*Attorney, Agent, or Firm*—Head & Johnson

[57] ABSTRACT

A trash collecting apparatus is described for mounting on a trash collection vehicle for one man side loading operation. A pair of spaced apart parallel guide rails each having a long vertical straight section and a short curved section at the top are pivotally attached to the vehicle at the top. A power cylinder is provided at the lower end of the guide rails for pushing and retracting the lower end of the guide rails from the vehicle. A grabber is provided for engagement with the trash can to be emptied. The grabber is connected to lifting arms. The lifting arms comprise an upper lifting arm segment and a lower lifting arm segment. A power cylinder drives the lifting arms so that the lower ends of the lower lifting arms follow the guide rails to the curved section. The grabber and the grabbed container are moved by the lower ends of the lower lifting arms and, as the lower ends of the lifting arms follow the curved portion of the guide, the container is inverted over the opening in the top of the refuse collecting truck. A lower grip on the apparatus engages with the grabbed container to support the container in the inverted position. Reverse movement of the lifting arms lowers the trash container.

5 Claims, 7 Drawing Sheets

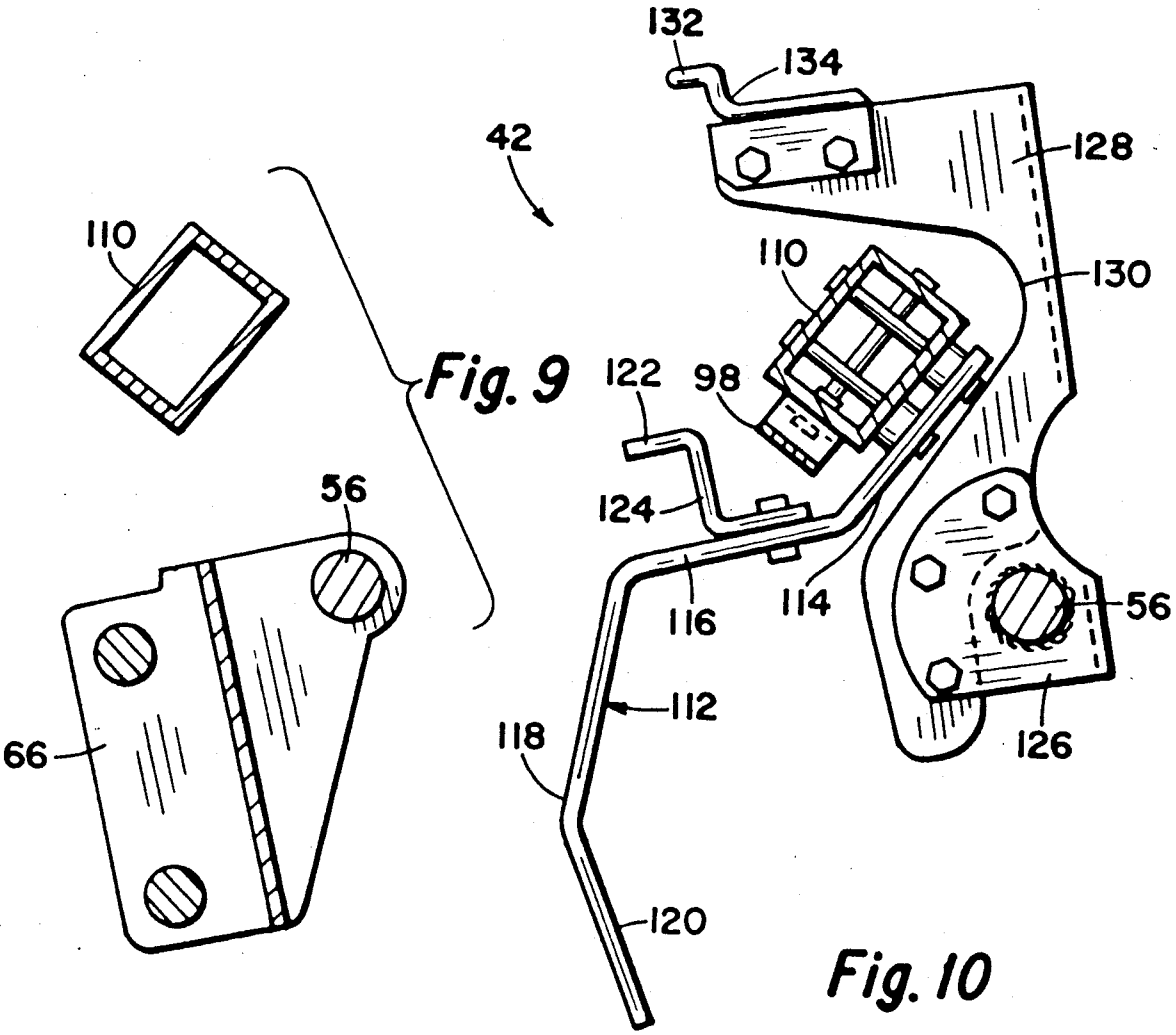
Fig. 9
Fig. 10
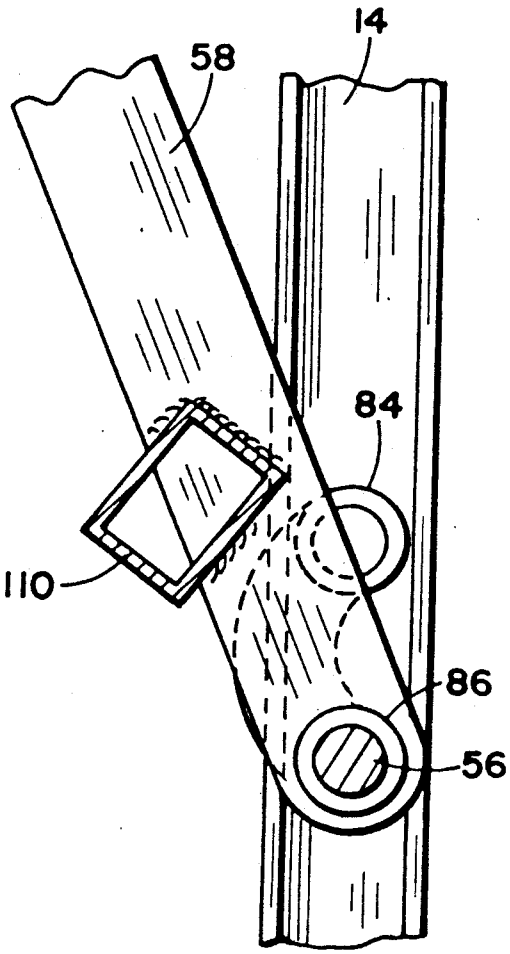
Fig. 8

SIDE REFUSE LOADER FOR VEHICLES

BACKGROUND OF THE INVENTION

1. Field of the Invention

This invention relates to an apparatus for lifting a trash container or a can to a dump position over a trash receiving vehicle. More particularly, the invention relates to an apparatus which is mounted preferably on the side of a trash receiving vehicle for lifting the trash container from a standard position to an inverted position over the top of the vehicle for dumping the contents of the trash container into a receiving chamber on the vehicle.

2. Related Patents

This invention uses the mechanism taught in U.S. Pat. No. 4,872,807 which is incorporated herein by reference.

3. Background of Trash Hauling

The pressing need to increase the efficiency of trash collection and to reduce the costs incurred in the trash collecting process has brought about increased mechanization of trash collection. To provide a mechanism for efficiently emptying trash containers into a collection vehicle, the prior art has resorted to innumerable mechanical arrangements. These disclosed apparatus provide for trash containers or cans to be lifted from the ground and dumped into a trash collecting vehicle with the lifting mechanisms raising the trash containers over the side, front or back of the vehicle through the use of tracks, rails, articulating arms, conveyer systems and the like. The prior apparata incorporate various degrees of complexities. It is well known in the trash collecting industry that such mechanisms are subject to extremely adverse operating conditions, giving rise to frequent breakdowns and resulting decreases in operating efficiency.

The efficiency of curbside pickup of trash could be greatly enhanced by standardization of the trash containers used in communities served by the same collectors. This standardization in turn requires a pick-up mechanism, operable from the cab of a trash collecting vehicle, capable of inter-connecting with the trash container, dumping the trash out of the container and into the vehicle and releasing the container at its original position.

It is therefore an object of the present invention to provide an improved trash can grabber for a trash collection apparatus for mounting on a trash collecting vehicle to grasp and lift a trash can, to dump the contents into the top of a vehicle and to return the can to it's original position.

SUMMARY OF THE INVENTION

The lifting mechanism has a pair of spaced apart essentially parallel guide rails which are mounted on the side of the trash collecting vehicle. Each guide has a long straight section with a curved section at the top. The two guide rails are pivotally attached at their upper ends to the trash collecting vehicle so that their lower ends may be pushed away from or drawn toward the vehicle while pivoting about the pivot at the top. A pair of hydraulic cylinders are provided for positioning the lower end of these guide rails by pulling them in or pushing them out.

A pair of lift arms are provided. Each lift arm includes an upper lift arm segment and a lower lift arm segment. The upper lift arm is fixed to an upper torsion bar which extends between the upper ends of the guide rails. The lower lift arm segment and the upper lift arm segment, which are about the same length, are connected by a pivot. The lower end of the lower lift arm segment is provided with two spaced apart rollers which follow the guide rail. A lower torsion bar or grabber support is connected between the lower ends of the two lower lift arm segments. The grabber of this invention is pivotally supported from this lower torsion bar and engages with an upper handle on the trash can to support it in an upright condition. A lower grip rigidly mounted between the lower arm segments engages with a lower handle on the trash can to support it in an inverted condition.

In operation, the operator of the trash collecting vehicle drives a vehicle so that the trash can is adjacent the side of the truck. The lower end of the guide rails is manipulated so that the grabber is in the proper position so that when actuated it will engage with the trash can. Then the lift cylinders are actuated to rotate the upper torsion bar which in turn rotates the upper lift arm segments which cause rollers of the lower end of the lower lift arm segment to follow the guide rails and bring with it the grabber and trash can. Continued movement of the roller along the guide rails causes the trash can to be turned inverted over an opening in the top of the truck and the trash is dumped out. The arm lifting cylinder is then reversed so that the trash can is lowered to the ground and the grabber withdrawn with the can repositioned on the ground where it was picked up. The truck is then ready to move on to its next location.

BRIEF DESCRIPTION OF THE DRAWINGS

Other objects and advantages of the invention will become apparent upon reading the following detailed description and upon reference to the drawings in which:

FIG. 8. is a view taken along the line 8—8 of FIG. 6.

FIG. 9. is a view taken along the line 9—9 of FIG. 6.

FIG. 10. is a view taken along the line 10—10 of FIG. 6.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
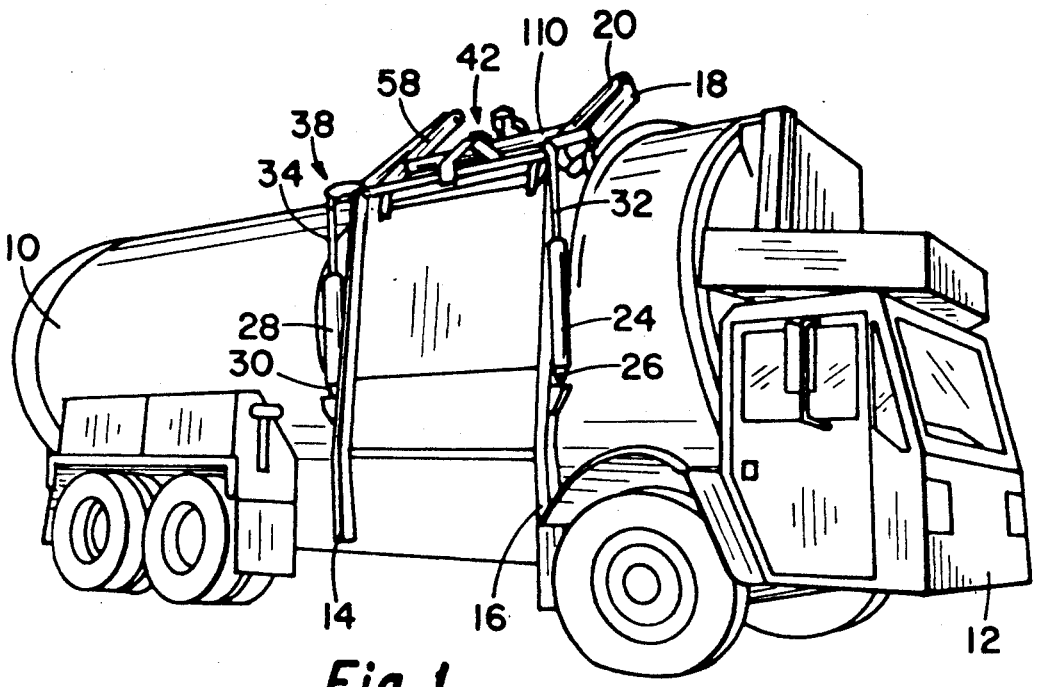
FIG. 1. illustrates a side view of a trash collecting vehicle with a side loading mechanism attached.

Attention is first directed to FIG. 1 which shows our trash loading apparatus mounted on the side of trash collecting bin or container 10 which is supported by a vehicle or truck 12. The bin 10 is provided with an opening in the top thereof which is not shown. The trash can lifting mechanism of FIG. 1 includes guide rails 14 and 16. There is a lift arm on each guide rail. On guide rail 16 this is shown as upper lift arm segment 18 and lower lift arm segment 20 which are pivotally connected at pivot 22. A first lifting cylinder 24 is pivotally attached at 26 to guide rail 16. A second lifting cylinder 28 is likewise attached at pivot 30 to guide rail 14. The upper ends of extension rods 32 and 34 of power lifting cylinders 24 and 28 are connected to driving mechanisms 36 and 38, respectively. These driving mechanisms are connected to a dumping torsion bar 40 which, as will be seen, causes the lifting arms to lift grabber 42 from the ground level to a position above the opening of bin 10.

Figure 2:
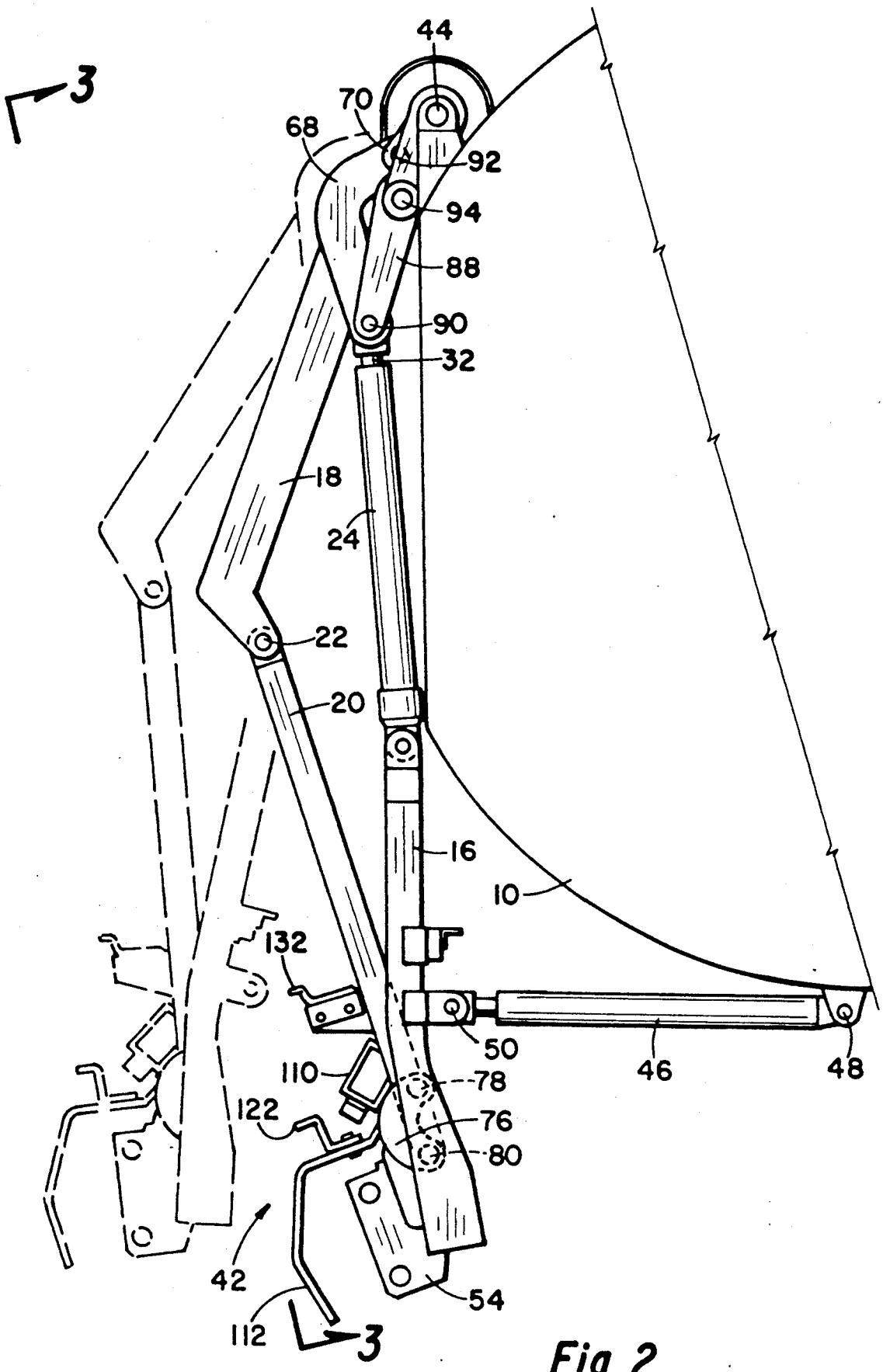
FIG. 2. illustrates the guide rail lifting arms and pivoting mechanism.
Figure 3:
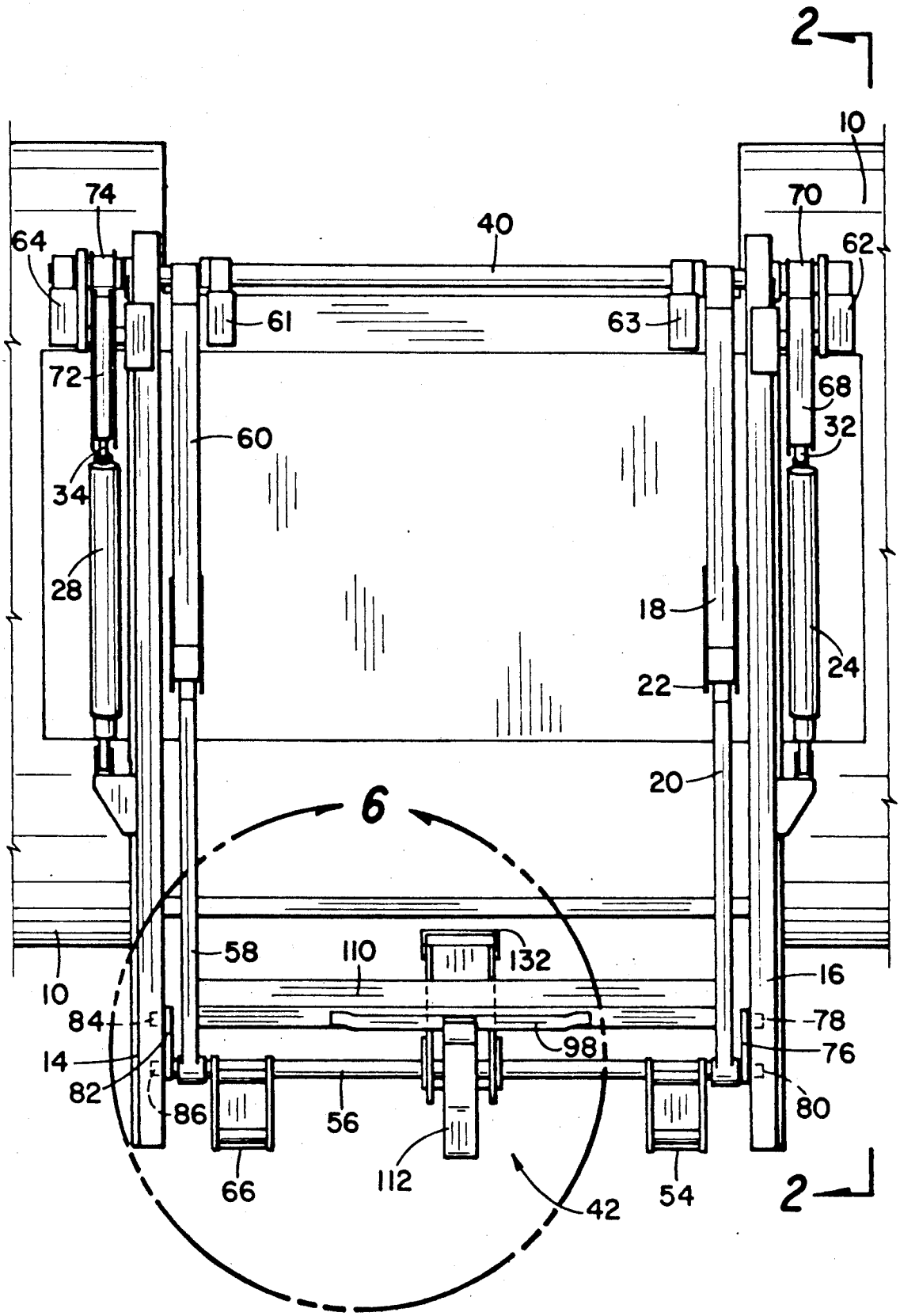
FIG. 3. is a view along the line 3—3 of FIG. 2 and illustrates a front view of the trash loading mechanism.
Figure 6:
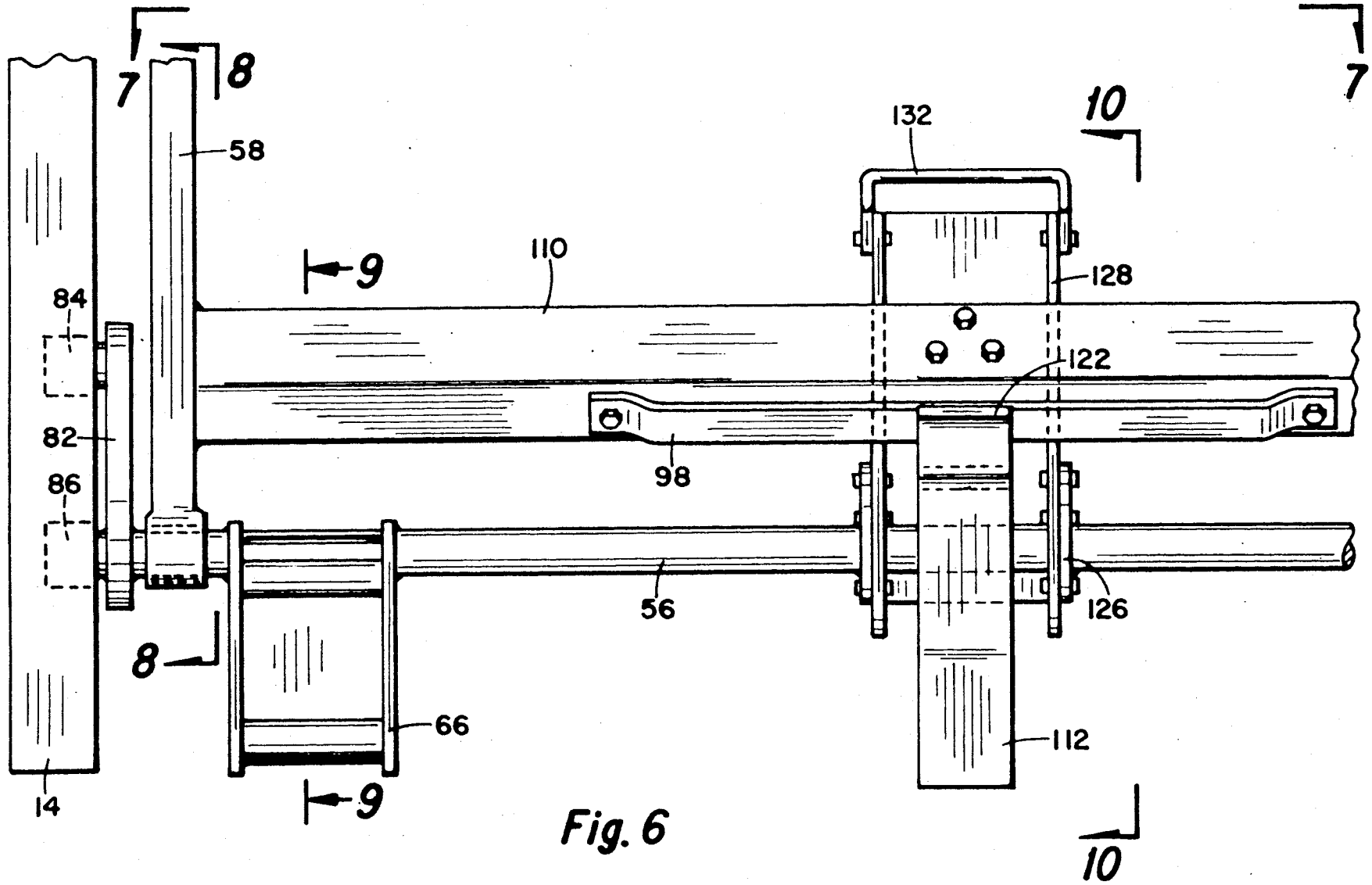
FIG. 6. is an enlarged detail view of segment "6" of FIG. 3.

Attention is next directed to FIG. 2 which shows the trash can grabber as it would approach a trash can. This FIGURE shows guide rails 16 pivoted about point 44 at the top which is about the axis of upper torsion bar 40. Stated differently, the upper end of the guide rails are pivotally supported from torsion bar 40. As shown further in FIG. 2 the lower end of guide rail 16 can be pushed away from the bin 10. This is accomplished by a rail cylinder 46 connected at pivot 48 to the bin 10. The extension rod of rail cylinder 46 is connected at pivot 59 near the lower portion of lower lift arm segment 16. The dashed line of the lower end of the lift arm segment illustrates the extension of the rod from rail cylinder 46 and shows how it is shoved away. As will be seen this has a very useful purpose. As can be seen in FIGS. 2 and 3, the grabber is supported from lower torsion bar 56 which is supported at the lower end of lower lift arm segment 20 on the right and on the left at the lower end of lower lift arm segment 58 which is supported from upper lift arm segment 60. The left hand lift arm assembly is the same as the right hand lift arm assembly. It is thus seen that by extending the piston rod of rail cylinder 46 that the grabber can be extended to the point or position where the trash can is located. The pivotal connection 22 between upper arm segment 18 and lower lift arm segment 20 is clearly shown in FIG. 12 of U.S. Pat. No. 4,872,801.

Attention is now directed to FIG. 3 which is a view taken along the line 3—3 of FIG. 2. At the top of FIG. 3 is the upper torsion bar 49 which is pivotally supported at one end by a support 64 and at the other end by a support 62. These supports 62 and 64 are welded or otherwise securely secured to the vehicle such as to the bin 10. Additional supports 61 and 63 ar similar to supports 62 and 64 and are provided to increase the stability of torsion bar 40. The torsion bar 40 rotates freely within these supports. The upper ends of guide rails 14 and 16 are mounted about torsion bar 40 in a rotational position. That is they can readily rotate on the bar 40. The upper end of upper lift arm segments 18 and 60 are welded or otherwise secured to the upper torsion bar 40. Thus as upper torsion bar 40 rotates, the lift arm segments 18 and 60 are also rotated. The length of the upper lift arm 18 (between the center of the pivot points) is longer by a distance X than the length of the lower lift arm 20 between the center of the pivots where X equals the inner radius of the guide at the top of the guide rails plus one half the distance of the width of the guide channel.

The upper extension of lift cylinder 24 is connected to a mechanism such that the extension of rod 32 rotates upper torsion bar 40. This mechanism, which will be explained more fully in relation to other FIGURES, especially 7 and 8, includes a dogleg 68, an idler link 88 and a drive link 70. Lift cylinder 28 likewise has its extension rod 34 connected to mechanism 38 which includes dogleg 72, drive link 74 and an idler link.

Attention is now directed back to FIG. 3 which shows at the lower part of the FIGURE a lower torsion bar 56 to which the lower lift arm segments 20 and 58 are pivotally attached. Each end of lower torsion bar 56 is provided with a pair of spaced apart rollers. One end of torsion bar 56 is provided with a curved plate 76 which is fixed to lower torsion bar 56. This curved plate has upper roller 78 and lower roller 80. Likewise, the other end of lower torsion bar 56 is provided with a curved plate 84 and lower roller 86. These rollers 78, 80, 84, and 86 follow guide rails 16 and 14 which are preferably provided with channels to receive these rollers.

Figure 7:
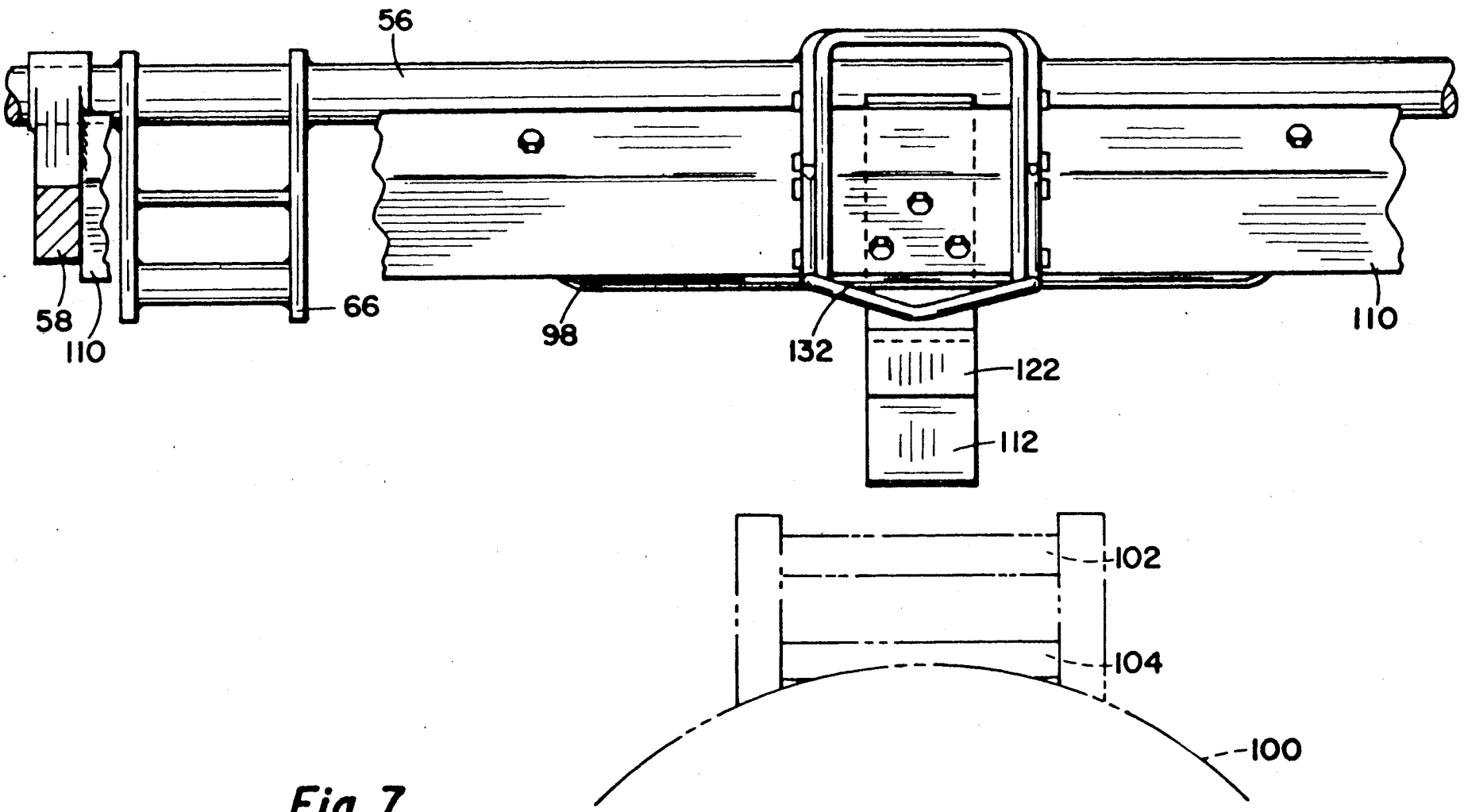
FIG. 7. is a view taken along the line 7—7 of FIG. 6.

Attention is next directed to FIGS, 4 and 5 to show the "four bar linkage" connection which connects the rods of lift cylinders 24 and 28 to the torsion bar 40. Shown thereon in FIG. 7 is dogleg 68, drive link 70 and idler link 88. The force, as indicated by arrow 96, from lift cylinder 24 is applied to pivot 90 which is also the pivot between dogleg 68 and idler link 88. Driver link 70 and dogleg 68 are connected by pivot 92. Idler link 88 is pivotally attached about pivot point 94 which is fixed to the guide rail.

Figure 4:
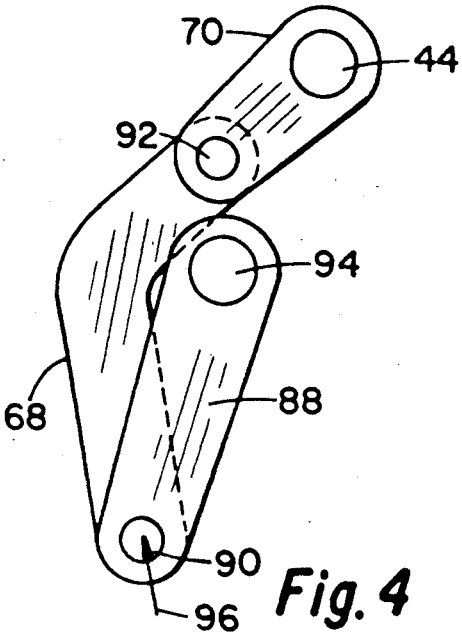
FIG. 4. illustrates a "four bar link" connecting the push rod of the hydraulic lift cylinder to the mechanism for lifting and rotating the can.
Figure 5:
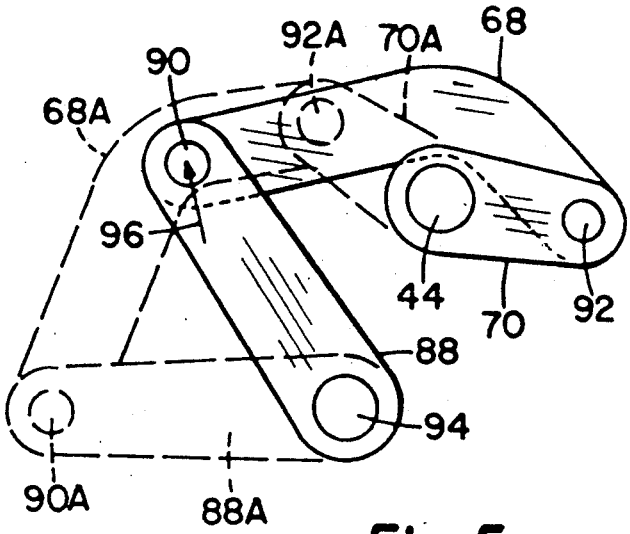
FIG. 5. is similar to FIG. 4 except it illustrates an "intermediate" position and a "full up" position of the lifting and rotation of the can.

When upward force is applied as indicated by arrow 96 which is a force from lift cylinder 24, the idler link 88 bent arm 68 and drive link 70 take the position indicated by the dashed lines, 88A, 68A and 70A in FIG. 5. As the driver link 70 rotates about axis or pivot point 44 the upper torsion bar 40 is also rotated inasmuch as driver link 70 is keyed or otherwise fixed to the torsion bar 40. Thus, in FIG. 4 the linkage is in the down position of the lift arms and in the dashed configuration in FIG. 5 the lift arms are in an intermediate position. Further upward movement by the piston rod 3 of the cylinder 24 will force the linkage mechanism into the position shown by the solid lines in FIG. 5. By reversing the force on the pivot 90 that is applying fluid to drive lift cylinder 24 in the opposite direction, the linkage of FIGS. 4 and 5 would just reverse from the flow up positions shown by the solid lines in FIG. 5 to the position shown in FIG. 4. This would take the lifting arms from the fully extended upright position as shown in FIG. 1 to the position in FIG. 2.

Applying fluid to cylinder 24 applies force to pivot 90, to idler link 88 and dogleg 68. Idler link 88 then pivots or rotates about pivot 94. This forces point 90 or the center of the pivot, to follow an arc of a fixed radius about the center of pivot 94. The dogleg forces the center of pivot 92 to move an equal distance to that traveled by point 90 inasmuch as pivot 92 and pivot 96 are a fixed distance apart inasmuch as dogleg 68 is rigid. Since driver link 70 and idler link 88 are not of equal length, point 92 travels unequal distances. The angular rotation of driver link 70 about axis 44 is equal to the angular displacement of idler link 88 divided by the length of driver link 70. By length we mean the distance for the idler link is that distance between the center of pivot 44 and pivot 92. Typically, it is preferred that there be a displacement of about two to one so that if dogleg 68 rotates 135° then driven link 70 rotates about 270°. These exact displacements are not absolutely required but they have been found to be quite satisfactory.

The relationship of rollers 78 and 80 with regard to the guide track will now be discussed. The two rollers maintain the orientation of the grabber 42 and the can 100 which it engages with respect to the guide rail until the upper roller starts traveling around the arc at the top of the guide rail. The distance between rollers 78 and 80 is substantially the same as the radius of the curved channel at the top of the guide channel or guide rail which, in one model which was built, was six inches. At that point the upper roller causes the lower torsion bar 56 to be rotated and this in turn causes the trash can carried by the grabber 42 to be turned upside down over the hopper area.

The lift cylinders 24 and 28 drive the driving mechanism which drives the upper torsion bar, that is it rotates it. Inasmuch as the upper arm segments are fixed to the torsion bar they rotate too. This causes the lower torsion bar to follow the guide rail.

Attention is now directed to FIGS. 6 through 10, which illustrate the grabber 42 which will engage the trash can 100. The lower left arm segments 20 and 58 are pivotally mounted on the lower torsion bar 56. Rigidly connected between the segments 20 and 58 is a lift strut 110. A lower grip guide 112 is bolted to the strut 110 at approximately its midpoint. The guide 112 is bent to four sequential planes such that in a first plane 114 the guide is parallel to one face of the strut 110, in the second plane 116 it is approximately perpendicular to the lift arm segments 20 and 58 and extends outwardly therefrom, in the third plane 118 the guide 112 turns downwardly at an angle to the second plane 116 and in the fourth plane 120 the guide turn further downwardly to approximately perpendicular to the second plane 116. In a preferred embodiment, the angle between the first and second plane is 220°, the angle between the second and third plane is 110° and the angle between the third and fourth plane is 150°. An S-shaped lower bracket 122 bolted to the second plane 116 of the guide 112 forms a U-shaped lower grip 124 with a mouth open outwardly of the grabber 42. Welded to the lower torsion bar 56 is a U-shaped bracket 126 to which is bolted a second U-shaped bracket 128 having sides contoured as at 130 to receive the lift strut 110 therein. An S-shaped upper bracket 132 mounted on the U-shaped bracket 128 forms an upper grip 134 aligned above but inwardly of the lower grip 124 as is best seen in FIG. 7. The trash can 100 has upper 102 and lower 104 handles bracketed outwardly from the can 100 with the upper handle 102 extended further from the center of the can 100 than the lower handle 104. When it is desired to empty a trash can 100, the truck is driven next to the can 100 with the grips 124 and 134 approximately centered on the handle 102 and 104 and the rail cylinder 46 in the retracted condition.

Figure 11:
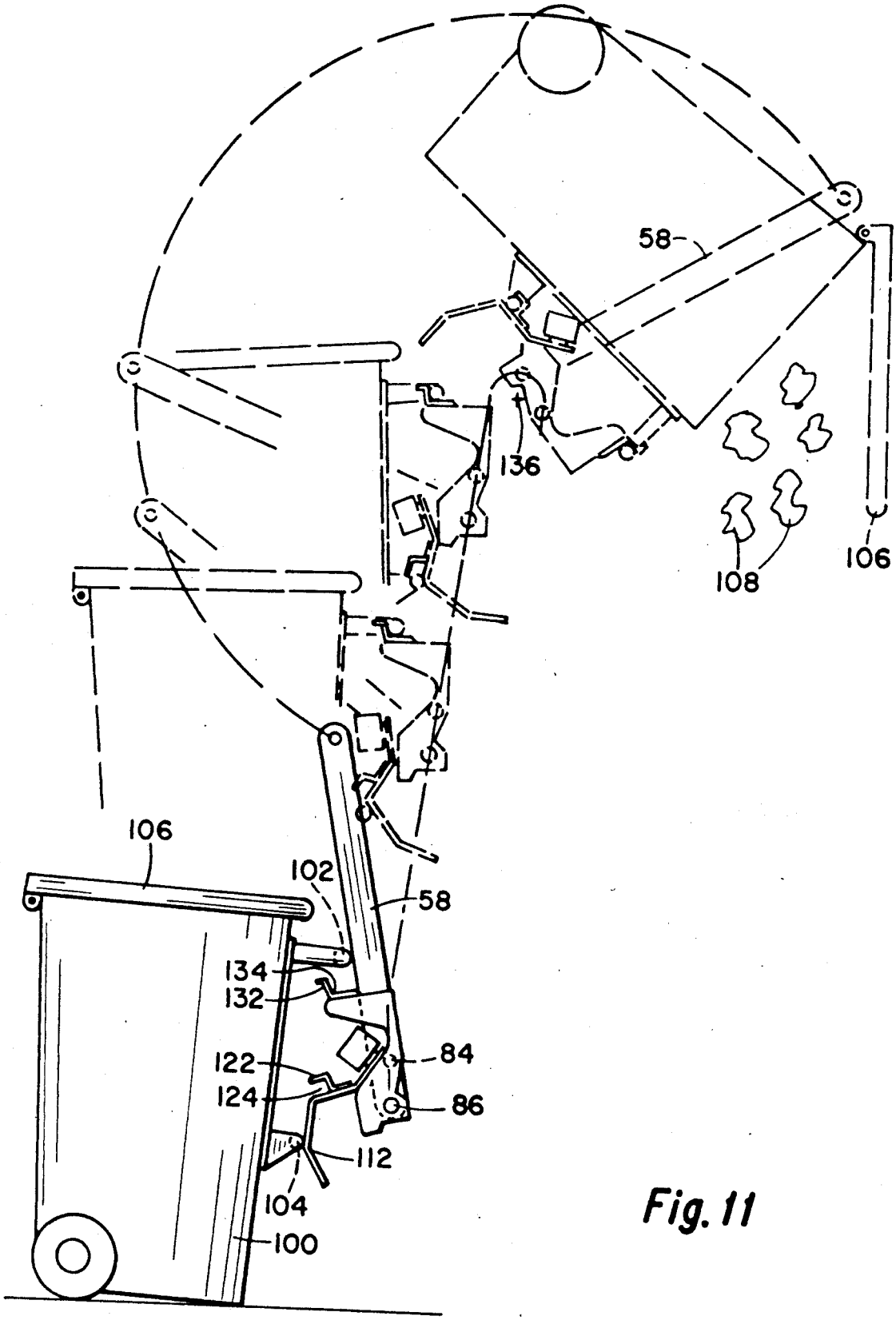
FIG. 11. is a schematic layout illustrating the trash can dumping cycle.

Once in this position the operation of the loader is quite simple, as can be seen in reference to FIG. 11. The operator moves the rails in by outwardly actuating the rail cylinder 46 until it is in the proper position. Once the lift cylinders 24 and 28 are energized, the rest is automatic. The can is lifted quickly through the sequence indicated in FIG. 11 and emptied. Sequentially, the rail cylinder 46 is extended until the lower grip guide 12 contacts the lower handle 104 of the upright can 100. In this condition, the upper grip 134 is aligned for vertical lift into engagement with the upper handle 102 of the can 100. As the upward motion of the upper grip 134 goes through the illustrated sequence the guide 112 prevents rotation of the can 100 about its upper handle 102. Meanwhile the space between the upper grip 134 and the lower grip 124 increases because the upper grip 134 rotates with the lower torsion bar 56 while the lower grip 124 does not. Thus, as the can 100 is upwardly lifted by the upper grip 134, the lower grip 124 travels relatively downward to engage the lower grip 124 with the lower handle 104 of the can 100. Then, as the can 58 rotates in a circular motion about the central axis 136 of the upper end of the guide rail 14 inverting the can 100 and shifting the center of gravity of the can 100 and its contents, the weight of the can 100 and its contents is transferred to engage the lower handle 104 of the can 100 with the lower grip 124. The weight of the can cover 106 and the trash 108 opens the cover 106, releasing the trash 108 into the bin 10. By reversal of the process, the can is placed on the curb. This is accomplished by energizing cylinders 24 and 28 to retract them. When the can reaches the ground, the cylinders 46, and therefore the grabber, are retracted and the truck is driven to the next can. This is a very efficient operation. In fact, with cans spaced forty feet apart, the system has been operated so that it takes only about eight seconds to empty one can and drive to the next can and be ready to run the operation on it. It is anticipated that this system can service over one thousand cans in a day.

This device may also include typical hook assemblies 54 and 66 fixed to the lower torsion bar 56 for pick up of other types of trash containers, as well as a leaf spring 98 fixed to the strut 110 to assist in supporting such containers.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What we claim is:

1. In an apparatus for use in conjunction with a trash can of the type having an upper handle and a lower handle extending from the same side of the trash can to lift the can from the ground to above the bin of a refuse collection vehicle so that the trash can is emptied through a hole in a top of the bin, the apparatus having two guide rails each with a guide channel having a long straight section and a curved section at the top end, an upper torsion bar rotatably supported from the bin at a fixed location with respect thereto near the top of the guide rails, means rotatably attaching the top ends of the guide rails to the upper torsion bar in a non-sliding relationship, push means pivotally connected to a lower end of the guide rails and the bin to rotate the guide rails about the upper torsion bar, grabber means for grabbing the trash can, a pair of lift arms, each arm having an upper arm segment and a lower arm segment movably connected thereto, means rigidly attaching the upper end of the upper arm segments to the upper torsion bar, means pivotally connecting the lower end of the lower arm segments to the grabber means including roller means to guide the grabber means along each of the guide channels and means to rotate the upper torsion bar, the improvement comprising:

a lower grip means rigidly mounted between said lower arm segments for engaging with the lower handle of the trash can, said grabber means for engaging with the upper handle of the trash can to support the can in an upright condition as the roller means moves along the straight section of the guide rails and said grabber means and said lower grip means cooperating with the upper and lower handles of the can to support the can in inverting and returning condition as the roller means moves along the curved section of the guide rails.

2. An improvement according to claim 1 further comprising guide means for preventing rotation of the can about the upper handle when the can is in an upright elevated condition.

3. An improvement according to claim 1, said upper and lower arm segments being connected by a pivot.

4. An improvement according to claim 3, said lower grip means comprising a strut fixed across the lower arm segments and bracket means centered on said strut forming a mouth for receiving the lower handle therein.

5. In improvement according to claim 4, said bracket means further comprising guide means for preventing rotation of the can about the upper handles when the can is in an upright elevated condition.

* * * * *